US008708248B2

(12) United States Patent
Liu

(10) Patent No.: US 8,708,248 B2
(45) Date of Patent: Apr. 29, 2014

(54) STRAW ADAPTED FOR CONSUMPTION OF NON-HOMOGENOUS BEVERAGES

(76) Inventor: Nathaniel Liu, Fremont, CA (US)

( * ) Notice: Subject to any disclaimer, the term of this patent is extended or adjusted under 35 U.S.C. 154(b) by 163 days.

(21) Appl. No.: 13/272,035

(22) Filed: Oct. 12, 2011

(65) Prior Publication Data

US 2013/0092750 A1 Apr. 18, 2013

(51) Int. Cl.
*A47G 21/18* (2006.01)

(52) U.S. Cl.
USPC ..... 239/12; 239/1; 239/24; 239/33; 138/109

(58) Field of Classification Search
USPC ..... 239/24, 33, 1, 12; 138/109
See application file for complete search history.

(56) References Cited

U.S. PATENT DOCUMENTS

| | | | | |
|---|---|---|---|---|
| 5,335,851 | A * | 8/1994 | Adaska et al. | 239/33 |
| 5,722,219 | A | 3/1998 | Dobransky | |
| 7,637,439 | B1 * | 12/2009 | Highsmith et al. | 239/33 |
| 2004/0256015 | A1 * | 12/2004 | Margetson | 138/109 |
| 2005/0103879 | A1 * | 5/2005 | Robinson | 239/33 |
| 2010/0258498 | A1 | 10/2010 | Finelli | |

* cited by examiner

*Primary Examiner* — Steven J Ganey
(74) *Attorney, Agent, or Firm* — J. Nicholas Gross

(57) ABSTRACT

A straw is provided for drinking beverages which may contain pieces, fragments, chunks, etc., of food matter. The straw has one or more notches, cuts or recesses located near an end portion which facilitates fluid intake even in the presence of blocking material.

10 Claims, 3 Drawing Sheets

STRAW ADAPTED FOR CONSUMPTION OF NON-HOMOGENOUS BEVERAGES

BACKGROUND

Straws have long been used to provide a conduit for liquid intake. Their long, hollow shape allows for the suction and easy consumption of most beverages. One primary benefit of using a straw is that it causes little to no spill and mess as a result of the limited rate at which fluid can flow through a straw. Straws can also easily be inserted atop conventional beverage containers to ensure that the contents can be enjoyed without the risk of spilling associated with an opening.

While a typical beverage straw can function properly for most homogenous beverages, such as water or a soft drink, a non-homogenous drink such as a smoothie or a milkshake may contain large particles of drink ingredients (for example, fruit chunks) which can impede or completely block the flow of liquid through the straw. An example of a prior art straw which attempts to address this problem is disclosed in US Publication 2010/0258498 A1 to Finelli. Other types of straws in the art have channels at one end to permit a fluid to pass by a set of flavored dissolvable beads to absorb the flavor of the beads. An example is a product offered under the trade name Magic Milk Straws.

While Finelli is an improvement over a conventional straw, embodiments of this disclosure will nonetheless still suffer from blockage caused by larger pieces or fragments of food/beverage or other material. The Magic Milk Straw also does not address this issue. To better address this limitation in certain beverages, an improved straw must be introduced.

SUMMARY

One goal of the disclosure is to provide a simple, cheaply produced straw that allows for the unhindered flow of fluid despite the presence of obstructive particles within a drink beverage or other fluid. The preferred straw features (one or more) recesses located at an inserted end, which allows a flow of fluid through the straw through a secondary intake mechanism even if the primary intake at an inserted end of the straw is blocked by a lodged piece. A related object of the disclosure is to provide for a simple tool/method that permits easy modification of a conventional straw to impart the necessary recesses in any desired pattern.

DESCRIPTION

Figure 1:
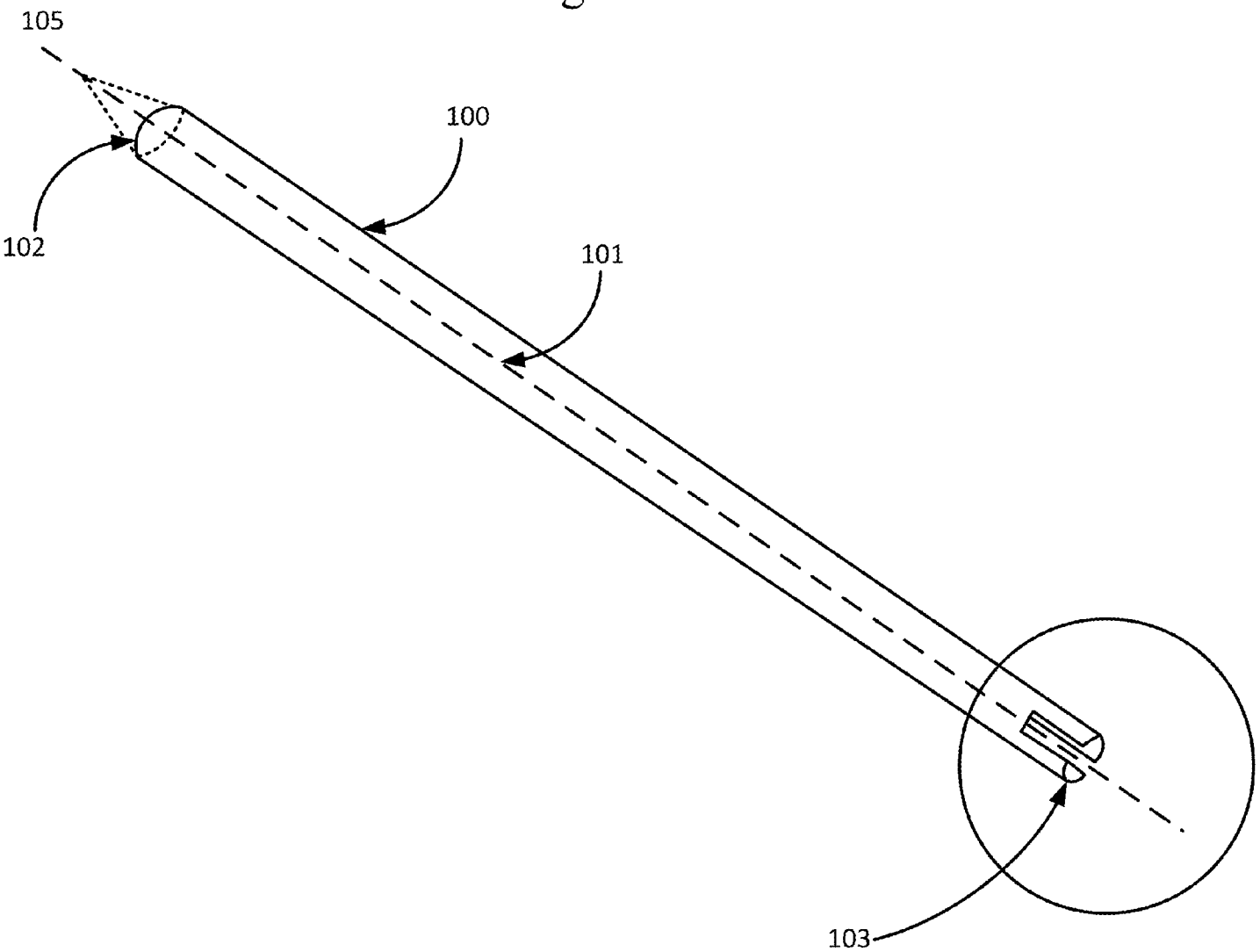
FIG. 1 shows a preferred embodiment of a straw of the present invention.

A preferred embodiment of a drinking straw 100 of the present invention is shown generally in FIG. 1. While the primary purpose of straw 100 is for consuming liquid materials, it will be apparent that the present teachings could be extended to other similar structures which use a suction mechanism for intaking a fluid. In addition it will be understood that the figures are only intended to be illustrative of the main features of the invention, and are not necessarily shown to scale or definitive proportions.

Straw 100 includes a body 101, which is preferably narrow, hollow and cylindrical when used for drinking beverages and is comprised typically of a plastic based material such as polypropylene. Other shapes and forms are of course possible and the invention is not limited in this respect. Additional information on the composition and techniques for making straws can be found at an online webpage—www.madehow-.com/Volume-4/Drinking-Straw.html and in U.S. Pat. No. 5,722,219 which are both incorporated by reference herein. Those skilled in the art will appreciate that other materials and techniques could be used of course consistent with the present teachings, including newer biodegradable compositions.

Straw 100 preferably includes two opposing ends as well, including a first end 102, which can be considered a mouth end, and a second end 103 which is inserted into the beverage and considered a primary beverage intake end. In the present invention the second end 103 is adapted particularly to maintain a flow 105 of liquid throughout the hollow body 101 even in the presence of some blocking material 106 in a beverage as seen in FIG. 2E. This result is achieved by a modification in the structure of the second end to implement a secondary intake such as shown in FIGS. 2A-2D.

As seen in an an expanded view 2A, a straw body 101 has a second end 103 that includes one or more notches, recesses or cuts 111. These latter structures combine to form and act as a secondary intake 104 for fluid for the straw, in addition to the primary intake formed by an end orifice portion of straw end 103. FIG. 2A also illustrates the extent of some of the general physical dimensions of straw 100, which includes a general diameter D in a hollow internal portion for transmitting beverage fluid. The straw size can be any conventional type used for consuming beverages. It should be appreciated that in instances where the fluid is other than a drinking beverage, the scale and proportions of the straw may vary.

The secondary intake structures 111 include generally a physical dimension width (W) and a length (L) that can be adjusted as desired by one skilled in the art using routine testing to accommodate different beverages, expected food fragments, etc. In a preferred embodiment the width (W) of the notches is less than a diameter D, which reduces the possibility of a secondary fragment from becoming lodged within the straw body 101. In many instances it will be desirable to ensure that a cross sectional area (L*W) of at least some of the notches 111 for the secondary intake 104 (depending on their location and proximity to the end) is less than that of the primary intake 103 ($\pi*(D/2)^2$) for the same reasons. Those skilled in the art will appreciate that the relationship of the secondary intake structures 111 to the width of the straw can be tailored as needed as well using routine testing for any particular combination of straws/fluids.

Figure 2C:
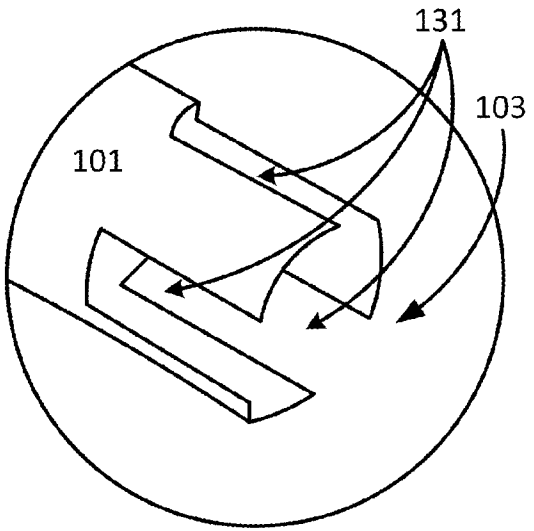
FIGS. 2B, 2C and 2D illustrate other variants of an end portion of a preferred embodiment of the invention.
Figure 2B:
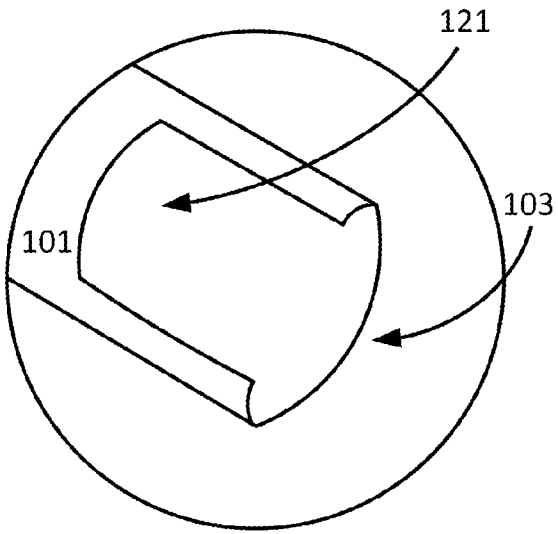
Figure 2A:
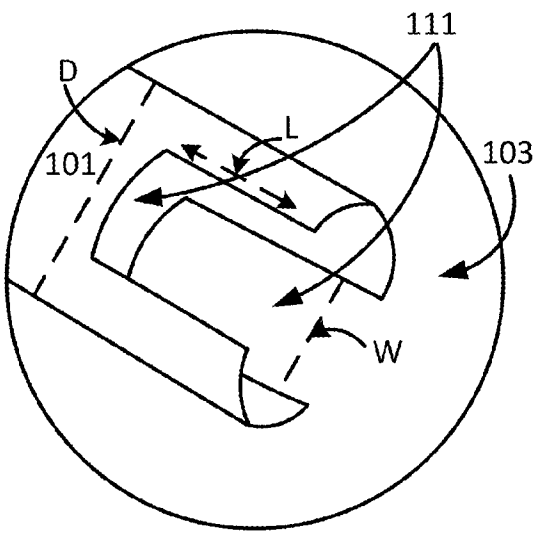
FIGS. 2A and 2E are blown up views of an end portion of the preferred embodiment of the present invention.
Figure 2E:
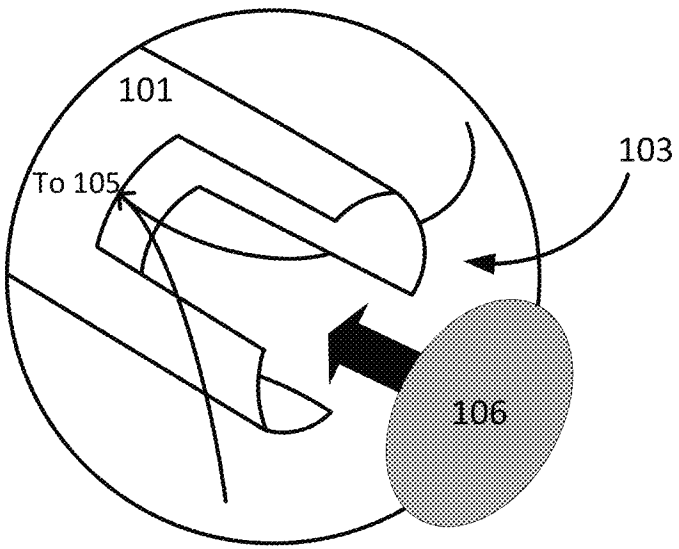
Figure 2D:
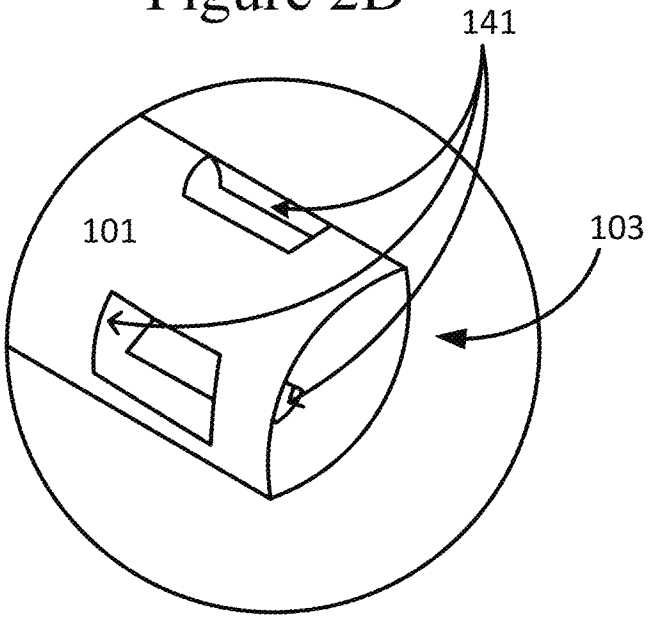

FIGS. 2B, 2C and 2D show alternative embodiments of straw 101 which incorporate different numbers, shapes, placements, etc. of notches or recesses. For example, FIG. 2B is an embodiment where a single notch 121 for a secondar intake 104 is slightly larger and close in areal size to an primary intake portion 103. FIG. 2C is another embodiment where three (3) notches 131 are used for a secondary intake. FIG. 2D is yet another embodiment in which a series of windows 141 are cut into straw body 101 to create a secondary intake which does not directly abut or border a primary intake portion 103. Again it will be understood that while recesses are shown generally as rectangular, other shapes (parabolic, circular, semi-circular, etc.) could be used in certain embodiments as well.

The invention helps overcome issues present in drinking a non-homogenous beverage containing large particulate materials capable of obstructing the end of an ordinary drinking straw preferably through the use of recesses located at the end of the straw. These types of particles, fragments, etc., cannot be passed through the drinking straw under suction conditions created by a human consumer of the fluid. The secondary intake permits substantial flow of fluid through the straw to the user even in the presence of food or other fragments (ice for example) in the end of the straw. These recesses are preferably rectangular in shape and share one edge with the end of the straw. Again, in general, a recess preferably has a longer length (L) than an edge width (W) that it shares with an end of straw 100.

If multiple recesses are used, they are preferably placed at regular intervals around a circumference of the end of the straw to preserve structural integrity. It is desirable that a substantial amount of the end of straw 101 remain intact and not be a part of the recesses so that should the primary intake/opening be obstructed, the recesses can still serve as a secondary intake which has additional viable paths for fluid flow.

As seen in FIG. 2D, an alternative to a recess that shares a side with the end of the straw 100 is a window-like recess 141 that terminates before the end of the straw. This would allow for additional structural integrity as well as a slightly different function when used for beverage intake.

Straw 100 can be manufactured and formed using any conventional known techniques in the art. For example, the aforementioned Internet accessible article explains generally how straws are made, and the present embodiments could be easily formed using similar techniques. That is, the notches and recesses 111 for the secondary intake could be part of a mold or tool that imparts the structural changes to a conventional straw during manufacturing.

Alternatively, in some applications/environments it may be desirable or useful to simply use a modified hole punch—preferably a hand held punch—to create the notches/recesses 111. For example, punch pliers (such as a model identified as GENERAL® Revolving Punch Plier) are known in the art for imparting holes, notches, etc. to materials including paper, plastic, leather, etc. These types of devices typically are configured with grips like a pair of scissors and have two arms which can be moved relative to each other so as to cause a metal hammer or punch to pierce/cut a desired shape into an article. For example, a paper hole punch can cause any number of desired shapes to be imparted to a piece of paper.

In the present case a straw 100 can be inserted and positioned in a modified hole punch (not shown) between a pair of opposing faces which have an opening sized for the notch/recess. A metal punch or a metal blade can then cut the desired pattern of notches, recesses, windows, 111 into straw body 101 as needed by hand using a combination of shearing, cutting, pressure etc.

A commercial establishment providing drink beverages could thus simply use a stock or inventory of conventional shape/sized straws which it could modify as needed for patrons and their beverage selections at the time of purchase. A handheld hole punch suitable for notching plastic straws could be provided to employees or workers to create the desired secondary intake in the straws. This approach has the advantage of avoiding tooling costs, manufacturing costs, stocking costs, etc. which might be otherwise associated with different straw types. Note that in some instances the patrons could be permitted to use the hole punch tool directly to impart any desired set of notches, recesses etc. and customize their own straws to their particular taste, beverage, etc. Automated cutting mechanisms could also be employed in some applications.

Those skilled in the art will appreciate that the benefits of a straw designed as described above are substantial. While preferred embodiments of the invention have been described herein it will be understood that the scope of subject matter embraced by the Applicant is defined by the attached claims.

What is claimed is:

1. A fluid intake tool having a substantially cylindrical body comprising:

an opening at each end of the substantially cylindrical body, including a first opening at a first end, and a second opening at a second end;

wherein said substantially cylindrical body is characterized by a first diameter and a first cross sectional area;

a first secondary intake opening with one or more recesses adjacent to said second end;

said one or more recesses being characterized by a shape having a recess length dimension and a recess width dimension, wherein said recess length dimension exceeds both said width dimension and said first diameter;

at least one second secondary intake opening with a second cross sectional area located on a wall of said substantially cylindrical body;

wherein said second cross sectional area is less than said first cross sectional area;

whereby fluid can be extracted through said first secondary intake opening and said at least one second secondary intake opening in the tool from a medium which includes obstructive particles.

2. The tool of claim 1 wherein the tool is a drinking straw.

3. The tool of claim 1 wherein a plurality of recesses for said first secondary intake opening are arranged with regular spacing whereby each one is spaced evenly around said second end of the tool and reasonable structural integrity of said second end of the tool is maintained.

4. The tool of claim 1 wherein each recess is a rectangular face imposed upon the sides of the cylindrical body.

5. The tool of claim 1 wherein said obstructive particles are ice or food fragments in a drink or beverage.

6. A method of providing a drinking straw adapted to communicate fluid from a beverage in the presence of food or ice fragments comprising:

providing a straw with a hollow body;

providing a hole punch tool adapted to form both a window and one or more notches or recesses in the hollow body adjacent to an end portion of the straw;

wherein said hollow body is characterized by a first diameter and a first cross sectional area;

said one or more notches or recesses being characterized by a shape having a length dimension and a width dimension, wherein said length dimension exceeds both said width dimension and said first diameter;

said windows being characterized by a second cross sectional area less than said first cross sectional area;

wherein said window and one or more notches or recesses are adapted to pass fluid through the straw even if said end portion is blocked by the food or ice fragments.

7. The method of claim 6, wherein said hole punch tool is a hand held device that can impart said windows, notches or recesses using manual force.

8. The method of claim 6 wherein said hole punch tool operates by shearing, cutting, or a combination of such.

9. The method of claim 6 wherein said hole punch tool creates more than one window, notch or recess at a time.

10. A method of consuming fluid from a beverage in the presence of food or ice fragments comprising:

communicating fluid in a straw positioned in the beverage from a first fluid intake opening to a second fluid receiving opening; and wherein said straw is characterized by a first diameter and a first cross sectional area;

communicating fluid through said straw from a second fluid intake opening and a third fluid intake opening to said second fluid receiving opening when said first fluid intake opening is blocked by the food or ice fragments, said first secondary intake opening including one or more recesses adjacent to said first fluid intake opening;

said one or more recesses being characterized by a shape having a recess length dimension and a recess width dimension, wherein said recess length dimension exceeds both said width dimension and said first diameter;

said third intake opening being located on a wall of said substantially cylindrical body and having a second cross sectional area;

wherein said second cross sectional area is less than said first cross sectional area;

whereby fluid can be extracted through said first fluid intake opening and said third intake opening in the straw from a medium which includes food or ice fragments.

* * * * *